US006015863A

United States Patent [19]

Mike et al.

[11] Patent Number: 6,015,863

[45] Date of Patent: Jan. 18, 2000

[54] POLYMERIC MANNICH ADDITIVES

[75] Inventors: Carl Anthony Mike, Chesterfield; Gregory Paul Anderson, Glen Allen; Carl Kurt Esche, Jr., Richmond, all of Va.

[73] Assignee: Ethyl Corporation, Richmond, Va.

[21] Appl. No.: 09/054,029

[22] Filed: Apr. 2, 1998

[51] Int. Cl.[7] ..... C08F 10/00

[52] U.S. Cl. ..... 525/333.7; 528/129; 528/137; 508/558

[58] Field of Search ..... 525/333.7; 528/127, 528/137; 508/558

[56] References Cited

U.S. PATENT DOCUMENTS

| | | | |
|---|---|---|---|
| 3,933,761 | 1/1976 | Coleman | 260/78.5 |
| 3,956,149 | 5/1976 | Coleman | 252/51.5 |
| 3,959,159 | 5/1976 | Coleman | 252/51.5 |
| 5,112,507 | 5/1992 | Harrison | 252/51.5 |
| 5,160,349 | 11/1992 | Cardis et al. | 44/331 |
| 5,259,968 | 11/1993 | Emert et al. | 252/51.5 |
| 5,266,186 | 11/1993 | Kaplan | 208/48 |
| 5,356,550 | 10/1994 | Cook et al. | 252/51.5 |
| 5,464,549 | 11/1995 | Sieberth | 252/51.5 |
| 5,608,029 | 3/1997 | Thaler et al. | 528/129 |
| 5,616,668 | 4/1997 | Harrison et al. | 526/271 |
| 5,719,108 | 2/1998 | Wilby et al. | 508/232 |

FOREIGN PATENT DOCUMENTS

| | | |
|---|---|---|
| 0773234 A1 | 5/1997 | European Pat. Off. . |
| 0775740 A2 | 5/1997 | European Pat. Off. . |
| 0776963 A1 | 6/1997 | European Pat. Off. . |
| WO 95/07944 | 3/1995 | WIPO . |

*Primary Examiner*—Edward J. Cain
*Attorney, Agent, or Firm*—Dennis H. Rainear; Thomas Hamilton

[57] ABSTRACT

Polymeric Mannich base condensates useful as fuel and lubricant additives. The polymeric Mannich base additives are the reaction products of poly (alpha-olefin/unsaturated acidic reactants) with Mannich base adducts of alkyl-substituted phenols condensed with aldehydes and amines.

53 Claims, No Drawings

POLYMERIC MANNICH ADDITIVES

TECHNICAL FIELD

This invention relates to compositions useful as lubricant and fuel additives which comprise polymeric Mannich base additives derived from poly (olefin-unsaturated acidic reagents) and Mannich base adducts of alkyl-substituted phenols condensed with aldehydes and amines. The polymeric Mannich additives of the present invention are useful as dispersant additives for oleaginous compositions and impart superior sludge protection, excellent low temperature properties and improved viscometrics to lubricant oils. The additives of the present invention advantageously impart fluidity modifying properties to lubricating oil compositions, which are sufficient to allow elimination of some proportion of the viscosity index improver from lubricating oil compositions containing these additives.

BACKGROUND OF THE INVENTION

Chemical additives for lubricating oils are used to control the physical and chemical properties of the oils. These additives are used to modify oil viscosity and viscosity index, to make the oils more resistant to oxidation, to keep engines and other mechanical equipment clean and protected against corrosion and wear, and keep particulate matter dispersed to minimize or eliminate sludge and deposits.

Hydrocarbon-based chemical additives are designed for specific functions by choosing a hydrocarbon type and molecular weight range or molecular weight distribution to allow the additives to function in the fluid type of interest. For instance, high molecular weight polymers can be used to increase viscosity and viscosity index of mineral oils or synthetic oils. Polar head groups can be designed to be attached to low or high molecular weight hydrocarbon tails to afford detergents, dispersants, antiwear, or anticorrosion agents.

Mannich base dispersants are a class of commercial crankcase dispersants. These compounds are typically produced by reacting alkyl-substituted phenols with aldehydes and amines, such as is described in U.S. Pat. Nos. 3,539,633; 3,697,574; 3,704,308; 3,736,535; 3,736,357; 4,334,085; and 5,433,875. The Mannich products of these inventions are monomeric and limited to relatively low molecular weight and viscosity as dictated by the phenol alkyl substituent's molecular weight. U.S. Pat. No. 5,608,029 details Mannich base polymers via thermal induced ring opening polymerization of cyclic Mannich reaction products of phenols and 1,2 alkylenediamines.

Recent patent disclosures exemplify the utility of polymeric dispersants for improving lube oil compositions. These inventions focus upon the free radical polymerization of olefin containing polymers and unsaturated acidic reactions. U.S. Pat. Nos. 5,112,507 and 5,616,668 detail the use of copolymers of high molecular weight vinylidene containing polymers and unsaturated acidic reactants as useful lube and fuel additives. WO 95/07944 details the polymerization of high molecular weight vinylidene containing polymers, low molecular weight monoethylenically unsaturated compounds, and acidic reactants.

The employment of acylating agents to improve lubricant dispersants is well exemplified in the art. U.S. Pat. No. 4,548,724 discloses that the reaction of polybutenyl succinimides with polycarboxylic acids affords improved dispersancy. U.S. Pat. No. 5,259,968 discloses improved dispersants comprising the reaction products of polyanhydrides and nitrogen or ester containing lubricant adducts. The disclosed polyanhydrides contain at least two anhydride moieties per hydrocarbyl radical joining the anhydride substituents. U.S. Pat. No. 5,464,549 discloses improved dispersants via the reaction of a nitrogen or hydroxy containing dispersant with telechelic compounds substituted with at least two maleic anhydrides or the like. U.S. Pat. No. 4,686,054 discloses the post treatment of succinimide dispersants with maleic or succinic anhydride. U.S. Pat. Nos. 4,509,955 and 4,566,983 disclose a mixture of acylating agents comprised of reaction products of maleic anhydride with both polyolefins of at least 30 carbons derived from C12–30 olefins and polyolefins of at least 30 carbons derived from C2–C8 olefins. U.S. Pat. No. 4,940,552 discloses the passivation of amine containing dispersants toward fluoroelastomers by reaction with dicarboxylic acid or anhydride.

U.S. Pat. Nos. 5,356,550 and 5,719,108 disclose succinimide dispersants obtained from the reaction of a maleic anhydride-olefin copolymer, a succinimide, and a primary or secondary amine. Several recent European Patent Applications disclose improved succinimide compositions utilizing unsaturated acidic reagent-olefin copolymers.

EP 0 776 963 A1 discloses succinimide compositions via alkyl or alkenyl succinic anhydrides, unsaturated acidic-olefin copolymers and polyamines. EP 0 775 740 A2 discloses dispersant/viscosity index improvers via the reaction product of a maleic anhydride-octadecene copolymer (Mn 6,300 to 12,000) and a polyalkyl or alkenyl succinimide and optionally a primary and/or a secondary amine. EP 0 773 234 A1 discloses the dispersant additives generated from the reaction of polyalkyl or alkenyl succinic anhydride, a polyamine, and an oligomer containing a functional group capable of reacting with an amine.

U.S. Pat. No. 5,266,186 discloses an iron sulfide dispersing agent useful to inhibit sludge deposits in refinery processing equipment generated by reaction of a maleic anhydride α-olefin copolymer with fatty amines. The patent further teaches that effective iron sulfide dispersants are made by reacting succinimides of polybutenyl succinic anhydrides and ethylenediamine with maleic anhydride-α-olefin copolymers.

U.S. Pat. No. 5,160,349 discloses the reaction products of maleic anhydride-α-olefin copolymers and heterocyclic compounds as useful antiwear agents in fuels. U.S. Pat. No. 4,391,721 discloses dispersant viscosity index improvers from the reaction of styrene maleic anhydride copolymers and tertiary amino alcohols. U.S. Pat. Nos. 3,933,761; 3,956,149; and 3,959,159 disclose useful lubricant and fuel additives from the reaction of α-olefin-maleic anhydride copolymers with alcohols and primary or secondary amines containing at least one tertiary amino group or heterocyclic amino group (such as N-alkyl morpholines, N-alkyl imidazoles, etc.).

U.S. Pat. No. 4,873,009 discloses a lube oil dispersant obtained by reacting a $C_8$ to $C_{500}$ polybutene succinic acid or anhydride compound and a hydroxypropoxylated alkylene diamine, the diamine being the reaction product of propylene oxide and an alkylene diamine. This patent also discloses that the dispersant may contain boron at a level that improves the compatibility of the dispersant toward fluorocarbon engine seals.

U.S. Pat. Nos. 5,080,815 discloses a dispersant composition comprising the reaction product obtained by reacting a $C_{30}$ to $C_{250}$ hydrocarbyl-substituted succinic anhydride with aminoguanidine. U.S. Pat. No. 5,454,962 discloses a dispersing agent made by reacting aminoguanidine with a hydrocarbyl-substituted succinic acid or anhydride in a mole ratio of from about 0.4 to about 1.2 moles of the aminoguanidine per mole of the succinic acid compound.

U.S. Pat. Nos. 5,238,588 and 5,162,086 disclose the incorporation of aromatic amines into maleic anhydride grafted ethylene propylene polymers to afford improved antioxidancy and dispersancy. The aromatic amines react with the succinic anhydride moieties of the grafted polymer.

Multigrade lubricating oils must simultaneously meet both low and high temperature viscometric requirements. The high temperature requirement insures the lubricating oil maintains sufficient protective thickness during engine operation, while the low temperature requirement insures oil pumpability in cold climates. Multigrade lubricating oils are typically designated as follows: SAE 5W30, SAE 10W30, SAE 15W40, etc. The first number in the sequence is associated with the low temperature viscosity requirement as measured by a cold cranking simulator (CCS) at high shear, while the second number is associated with the high temperature viscosity requirement (typically the 100° C. kinematic viscosity). ASTM requirements establish the viscosity limits for specific multigrade oils (e. g. a 5W30 oil requires a −25° C. CCS of ≦3500 cP and a 100° C. viscosity of 9.5 to 12.4 cSt.)

The dual temperature viscometric requirements for multigrade motor oils presents a major challenge to oil formulators. Formulators utilize viscosity index improvers to address multigrade oil specifications. Conventional viscosity index improvers are oil soluble high molecular weight polymers that afford significant kinematic viscosity increase to base oils. Viscosity index improvers contribute more to the high temperature viscosity of base oils than to the low temperature viscosity of base oils. Solution properties of high molecular weight polymers tend to afford lower viscosities in high shear environments.

The base oils utilized for lubricating compositions have characteristic natural viscosities. While blending base oils of different natural viscosities may meet the high temperature viscosity limits for a multigrade oil, the resulting blend may exceed the required low temperature viscosity. A balance of viscosity index improver and base oil is often employed to achieve a desired multigrade oil.

The balance of base oil and viscosity index improver can present limitations. Incorporation of higher amounts of viscosity index improver into lubricating oils to address high temperature requirements, can result in exceeding the low temperature requirement. While the use of lower natural viscosity base oils can improve the low temperature viscometrics, the lower natural viscosity base oils can result in performance debits. Lower natural viscosity base oils are not as effective in diesel engines and are more prone to volatilization.

The dispersant additives incorporated into lubricating compositions to maintain engine cleanliness and prevent harmful deposits often have an antagonistic effect on the viscometric requirements of multigrade oils. The typical dispersant treat rates required to provide adequate dispersancy increase both the low and high temperature viscosities of base oils. Generally, the dispersants exhibit a more pronounced effect on the low temperature viscosity than on the high temperature viscosity, which can result in an increased low temperature viscosity which exceeds or approaches the required limit.

Formulation of multigrade motor oils becomes increasingly more difficult with this inherent dispersant antagonistic low temperature viscometric effect. A delicate balance of viscosity index improver and increasing proportions of undesirable low natural viscosity base oils is often required to address both the low and high temperature viscometric requirements of motor oils. The polymeric dispersants of the current invention impart excellent blending versatility to lubricating oils. The polymeric dispersants of the current invention afford excellent low temperature viscometrics while permitting the use of advantageous higher natural viscosity base oils. Thus, the polymeric dispersants of the present invention facilitate the formulation of multigrade oils versus conventional dispersants.

The prior art fails to suggest or disclose the novel polymeric Mannich base additives of the present invention which comprise poly(olefin-unsaturated acidic reagents) reacted with Mannich base adducts of alkyl substituted phenols condensed with aldehydes and amines. The materials of this invention are thus an improvement over conventional dispersants because of their effectiveness as dispersants coupled with enhanced blending versatility. The Mannich additives of this invention are distinctive in that they are polymeric rather than monomeric which serves to generate higher molecular weight and higher viscosity Mannich dispersants from conventional starting materials.

The polymeric Mannich additives of the present invention are useful as dispersant additives for oleaginous compositions and impart both superior sludge protection and improved viscometrics to lubricant oils. The polymeric Mannich dispersants of this invention are also essentially chlorine free. The polymeric Mannich dispersant of this invention also exhibit improved compatibility toward fluorocarbon engine seals.

SUMMARY OF THE INVENTION

In general, the present invention is directed to novel compositions useful as lube oil and fuel additives which comprise polymeric Mannich base additives derived from poly (olefin-unsaturated acidic reagents) and Mannich base adducts of alkyl-substituted phenols condensed with aldehydes and amines. Another aspect of the present invention is directed to the reaction of the polymeric Mannich base additives of this invention with amines, alcohols, and/or amino alcohols. The invention further relates to post-treated products prepared by reacting the polymeric Mannich base additives prepared in accordance with the invention with a post-treating agent selected from the group consisting of inorganic or organic phosphorus compounds, boron compounds, mono- or polycarboxylic acids and derivatives thereof.

DETAILED DESCRIPTION OF THE INVENTION

The polymeric Mannich base additives useful in lubricating and fuel compositions comprise the reaction products of the following reactants:

1) at least one Mannich base condensation product of a hydrocarbyl hydroxy aromatic compound with an aldehyde and an amine, with 2) at least one poly(a-olefin-unsaturated acidic reagent), and 3) optionally the reaction products of reactants 1 and 2 above with amines, alcohols, or amino alcohols, or mixtures thereof, and 4) optionally the post-treatment of any of the above reaction products with organic or inorganic phosphorus compounds, boron compounds, mono- or polycarboxylic acids and derivatives thereof.

Each of the reactants (1–4) that can comprise the polymeric Mannich dispersants of the present invention are described in detail in the following designated sections.

Mannich base condensation products suitable for use in preparing the materials of the present invention are prepared by condensing a hydrocarbyl substituted hydroxy aromatic compound with an aldehyde such as formaldehyde or paraformaldehyde and an amine. Materials described in the following U.S. Pat. Nos. are illustrative: 3,442,808; 3,694,229; 3,798,154; 3,980,569; and 4,334,085.

Such Mannich condensation products may include a long chain, high molecular weight hydrocarbyl substituent on the hydroxy aromatic compound or may be reacted with a compound containing such a hydrocarbon, e.g., polyalkenyl succinic anhydride as described in U.S. Pat. No. 3,442,808.

The hydrocarbyl substituted hydroxy aromatic compounds used in the preparation of the Mannich base condensates are a broad class of aromatic compounds having at least one hydrocarbyl group and at least one open ring position adjacent to the hydroxyl(s). Thus, the hydroxy aromatic compounds include those of the general formula:

$$(Ar)_x—(OH)_y$$

where Ar represents phenyl, anthracenyl, napthenyl, phenylene, biphenylene, etc., such that x is usually 1,2, or 3, preferably 1, and y is 1 or more. Suitable compounds include phenols, especially substituted phenols such as para-alkyl phenols wherein the alkyl substituent is derived from the polymerization of mono olefins. Such olefins include ethylene, propylene, butylene, pentene, 1-octene, styrene, etc. The polymers may be homopolymers such as polyisobutylene, as well as copolymers of two or more such olefins such as copolymers of ethylene and propylene, butylene and isobutylene, propylene and isobutylene; etc. Other copolymers include those in which a minor amount of the copolymer monomers are derived from a diene, e.g. a copolymer of isobutylene and butadiene, or a copolymer of ethylene, propylene, and 1,4-hexadiene, etc.

In some cases, the olefin polymer may be completely saturated, for example, an ethylene-propylene copolymer generated via Ziegler-Natta catalysis using hydrogen to control molecular weight.

The olefin copolymers will typically have a number average molecular weight (Mn) within the range of about 400 to about 20,000, more typically between about 700 and 10,000 as determined by gel permeation chromatography (see, for example, see W. W. Yau, J. J. Kirkland, and D. D. Gly, "Modern Size Exclusion Liquid Chromatography", John Wiley and Sons, New York, 1979). Particularly useful olefin polymers are those having number average molecular weights within the range of 700 to 5,000, and more preferably within the range of 900 to 3,000 with approximately one terminal double bond per polymer chain. Polyisobutylene is an especially useful starting material for highly potent dispersant additives made in accordance with this invention. The number average molecular weight for such polymers can be determined by several known techniques.

Processes for substituting the hydroxy aromatic compounds with such olefin polymers are known is the art, for example, in U.S. Pat. Nos. 3,539,633 and 3,649,229.

Representative hydrocarbyl substituted hydroxy aromatic compounds contemplated for use in this invention include, but are not limited to, 2-polypropenyl phenol, 3-polypropenyl phenol, 4-polypropenyl phenol, 2-polybutenyl phenol, 3-polybutenyl phenol, 4-polybutenyl phenol, 2-polyisobutenyl phenol, 3-polyisobutenyl phenol, 4-polyisobutenyl phenol, 4-polyisobutenyl-2-methylphenol, 4-polyisobutenyl-2-chlorophenol, and the like. As well as polyolefin-substituted catechols, the polyolefin substituted resorcinols, and the polyolefin substituted hydroquinones, e.g. 4-polyisobutenyl-1,2-dihydroxybenzene, 3-polypropenyl-1,2-dihydroxybenzene, 5-polyisobutenyl-1,3-dihydroxybenzene, and the like.

Suitable hydrocarbyl naphthols include 1-polyisobutylene-5-hydoxynaphthalene, 1-polypropylene-3-hydroxynaphthalene, and the like.

The preferred long chain hydrocarbyl substituted aromatic compounds to be used in this invention can be illustrated by the formula:

$$R—(Ar)_x—(OH)_y$$

wherein Ar is as defined above, R is hydrocarbyl of from about 25 carbons to 350 carbon atoms, and preferably is a polyolefin derived from a C2 to C10 mono-α-olefin, and x and y are 1.

The aldehyde material, which can be employed in the production of the Mannich base condensate, is represented by the formula:

$$R^1—C(=O)—H$$

wherein $R^1$ is a hydrogen or an aliphatic hydrocarbon radical having from 1 to 10 carbon atoms. Examples include formaldehyde and its equivalents or precursors in various forms. These include paraformaldehyde, polyformaldehyde, aqueous formaldehyde, and trioxane. Other aldehydes group containing compounds such as C2 to C10 hydrocarbyl aldehydes (e.g. acetaldehyde, propionaldeyde, butyraldehyde, etc.) can be employed. Preferred are those wherein $R^1$ is H or C1 to C4 alkyl.

The amines useful to prepare the Mannich base condensates include mono and polyamines. The monoamines are ammonia and amines containing one primary amine. The substituents on the nitrogen atom of the monoamine can be independently selected from hydrogen or alkyl groups having from one to about 30 carbons. Examples of suitable monoamines are ammonia, methyl amine, ethyl amine, propyl amine, isopropyl amine t-butyl amine, hexyl amine, decyl amine, eicosyl amine, and the like.

Polyamines suitable for use in forming Mannich base condensates have at least one primary or secondary amino group in the molecule. The polyamine is preferably one or a mixture of polyamines which has at least one primary amino group in the molecule and which additionally contains an average of at least one other amino nitrogen atom in the molecule.

One preferred type of polyamine is comprised of 1,2-alkylene polyamines such as those represented by the formula:

$$H_2N(CH_2)_n[NH(CH_2)_n]_mNH_2$$

wherein n is 2 to about 10, preferably 2 to 6, and m is 0 to 10, preferably 0 to 2, and mixtures thereof. Cyclic polyamines such an aminoalkyl-piperazines, e.g. β-aminoethyl-piperazine, can also be used in the invention provided at least one primary amine group is present. Examples of suitable polyalkylene polyamines are ethylene diamine, hexamethylenediamine, diethylenetriamine, bis(aminopropyl)-ethylene diamine, bis(aminopropyl)-piperazine, bis(aminoethyl)-piperazine, etc.

Other useful polyamines are represented by the formula $$R^2NHCH_2CH_2NH_2$$

wherein $R^2$ is a hydrocarbyl having 2 to 25 carbon atoms.

In principle, any polyamine having at least one primary amino group and at least one other amino nitrogen atom in the molecule can be used in forming the Mannich base condensates useful in the additives of this invention. However, it is desired that the particular polyamine chosen does not cause significant gelling in the final polymer.

The poly(olefin-unsaturated acidic reagents) useful in the present invention may be random or alternating copolymers. Such polymers are commercial products or may be prepared by the polymerization of an olefin and an unsaturated acidic reagent possessing a functional group that will react with a nucleophilic reagent such as an amine or alcohol. Particularly suitable compounds include copolymers of α-olefins, styrene or 1,3-butadienes with maleic anhydride or acrylic acid. The poly (olefin-unsaturated acidic reagents) are generated by the polymerization of C2 to C30 α-olefins, styrenes, 1,3-butadienes and an unsaturated acidic reactant such as maleic anhydride. The copolymerization is typically conducted in the presence of a peroxide or azo free radical initiator, such as di-t-butyl peroxide, dicumyl peroxide, azoisobutyronitrile, etc. U.S. Pat. Nos. 3,560,455 and 4,240,1916 disclose processes for preparing α-olefin-unsaturated acidic reactant copolymers.

Examples of some commercial poly(olefin-unsaturated acidic reactants) include: Poly(α-olefins-co-maleic anhydride) copolymers available from Chevron Chemicals as PA-18 (1-octadecene-co-maleic anhydride), poly(styrene-co-maleic anhydride) copolymers available from ARCO Chemical or Monsanto under the tradenames SMA® resins or Lytron® resins; respectively, poly(isobutene-co-maleic anhydride) and poly(butadiene-co-maleic anhydride).

The poly(olefin-unsaturated acidic reactant) copolymers typically have a number average molecular weight of from about 10,000 to about 70,000.

The polymeric Mannich compounds of the present invention can be prepared by contacting the desired Mannich base condensate with a poly(olefin-unsaturated acidic reagent) under reactive conditions.

A general representation of this reaction of a Mannich bases condensate with the poly(olefin-unsaturated acidic reagent) is set forth below:

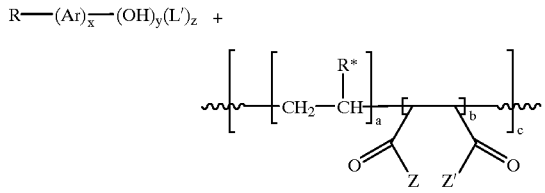

where L' is $CHR^1NR'[(CH_2)_nNH]_m(CH_2)_nNH_2$, R' is hydrogen or alkyl; $R^1$ is hydrogen or C1 to C10 alkyl, z is 1 or 2, and Ar, R, x, y, m, and n are as described above; R* is hydrogen, C1 to C36 alkyl, or phenyl; and a, b, and c independently are integers greater than or equal to 1; Z and Z' independently are the same or different, provided that at least one of Z and Z' is a group capable of reacting to form amides, imides, or amine salts with ammonia or amines, to esterify alcohols, or otherwise function to acylate. Typically, Z and/or Z' is —OH, —O-hydrocarbyl, —$NH_2$, —Cl, —Br, and taken together Z and Z' can be —O— so as to form an anhydride. Preferably, Z and Z' are such that both carboxylic functions can enter into acylation reactions. The anhydride or carboxylic acid functionality is particularly preferred.

A representation of this reaction is shown below for a Mannich base condensate with the selection of poly(olefin-maleic anhydride) as the poly(olefin-maleic unsaturated acidic reagent):

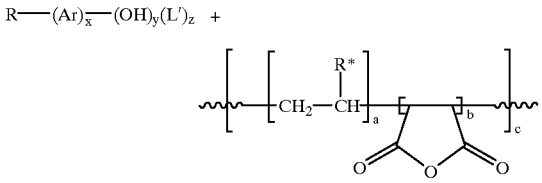

where Ar, R, L', x, y, and z are as described above; R* is hydrogen, C1 to C36 alkyl, or phenyl; and a, b, and c independently are integers greater than or equal to 1.

The following general formula represents a reaction product of the present invention:

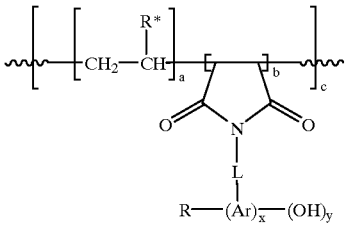

Where: R* is hydrogen or C1 to C36 alkyl

Ar is as denoted above x is an integer 1 to 3 y is an integer 1 or greater

R is an alkyl substituent Mn 500 to 10,000

L is $(CH_2)_n[NH(CH_2)_n]_mNR'CHR^1$ n and m are as denoted above

R' is hydrogen or C1 to C10 alkyl;

$R^1$ is hydrogen or C1 to C10 alkyl a, b, and c are independently integers greater than or equal to 1.

Although initiating and terminating groups are omitted in the above general figure for clarity, those skilled in the art will readily recognize such groups will be a product of the free radical reaction utilized to prepare the poly(olefin-unsaturated acidic reagents). Thus, the initial and terminal groups may vary with particular poly(olefin-unsaturated acidic reagents) and secondary reactions inherent in such polymerizations.

Basically, the general formula above can be considered a polymeric Mannich base produced from the linking of monomeric Mannich products with poly(olefin-unsaturated acidic reagents) via the amine substituents of the precursor Mannich base condensates.

In addition to the general formula above, typically the reactions will contain more complex reaction products and polymers due to competing and sequential reactions, and because the Mannich base condensates can contain more than one amine moiety per alkyl substituent. The Mannich base condensates may also contain amino moieties of varying reactivity. For example, secondary amino groups in the Mannich base condensates would afford amide type functionality in resulting products.

Another aspect of the present invention is directed toward the reaction of the polymeric Mannich base additives of the invention (reaction products of Mannich base condensates and poly(olefin-unsaturated acidic reagents) with amines, alcohols, and/or amino alcohols. Amine compounds (including monoamines, polyamines, polyether amines, polyhydroxy amines, and polyoxyalkylene polyamines) that are useful in forming the dispersants of this invention are those containing reactive amino groups, i.e., primary and/or secondary amino groups. The primary and secondary amines may be aliphatic or aromatic. Both saturated and unsaturated amines are suitable. The amines include polyalkylene amines, hydrocarbyl amines, and hydrocarbyl amines containing other groups, e.g., hydroxy groups and the like. Amines of this type as well as polyols that can be used in forming ester-amide type dispersants are extensively described in the patent literature, such as, for example U.S. Pat. Nos. 4,234,435, 4,873,009 and 5,137,980 the disclosures of which are herein incorporated by reference. The polyamine is preferably one or a mixture of polyamines which has at least one primary amino group in the molecule and which additionally contains at least one other amino nitrogen atom in the molecule.

One preferred type of polyamine is comprised of alkylene polyamines such as those represented by the formula:

$$H_2N(CH_2)_n[NH(CH_2)_n]_mNH_2$$

wherein n is 2 to about 10, preferably 2 to 6, and m is 0 to 10, preferably 0 to 6, and mixtures thereof. Cyclic polyamines such an aminoalkyl-piperazines, e.g. β-aminoethyl-piperazine, can also be used in the invention. Another preferred type of polyamine is comprised of hydrocarbyl polyamines containing from 10 to 50 weight percent acyclic alkylene polyamines and 50 to 90 weight percent cyclic alkylene polyamines.

The macromolecular multibranched polyfunctional amines known in the art as dendrimers or arborols are also useful in this invention. The macromolecular amines include the polyamidoamines "Starburst dendrimers" such as those described in U.S. Pat. No. 4,694,064. Additional macromolecular amine examples are described by G. R Newkome et al. in "Dendritic Molecules", VCH Publishers, Inc., (1996).

Primary or secondary aminoalkyl-substituted tertiary amines are also suitable for reaction with the Mannich base condensates/poly(olefin-unsaturated acidic reagents) additives of this invention. These polyamine compounds contain at least one mono- functional amino group such as a tertiary or heterocyclic amino group in addition to a primary or secondary amino group. In general, such amines include tris(2-aminoethyl) amine, aminoalkyl-substituted morpholines (such as 4-(-3aminopropyl) morpholine), imidazoles (such as 1-(3-aminopropyl) imidazole), piperazines, pyridines, pyrroles, etc.

In principle, any polyamine having at least one primary amino group and at least one amino nitrogen atom in the molecule can be used in forming the dispersants of this invention. Commercial mixtures of amine compounds may advantageously be used. Low cost poly(ethyleneamine) compounds are commercially available under trade names such as "Dow Polyamine E-100", "Dow Polyamine S-1107", "Polyamine H", "Polyamine 400", etc. Such polyamines may be alkoxylated e.g. by incorporation of 1 to 2 N-substituted C2 or C3 hydroxyalkyl groups per molecule, preferably β-hydroxyethyl groups.

Polyoxyalkylene polyamines (for example materials supplied under the trade name Jeffamine®) are also suitable for the dispersants of this invention.

Other polyamines that can be used in making the dispersants of the present invention include, e.g. aminoguanidine and/or a basic salt thereof, for example aminoguanidine bicarbonate as described in U.S. Pat. No. 4,908,145, incorporated herein by reference.

The Mannich base condensates/poly(olefin-unsaturated acidic reagents) polymeric dispersants of this invention may also be reacted with aromatic amines. Suitable non-limiting aromatic amines include N-arylphenylene diamine (such as N-phenyl phenylene diamine), aminopyridines, arminopyrazines, aminopyrimidines, and aminophenothiazines. Examples of such aromatic amines are detailed in U.S. Pat. Nos. 5,162,086 and 5,238,588, both of which are incorporated herein by reference.

In addition to amines, monohydric or polyhydric alcohols are suitable for reaction with the polymeric Mannich/poly (olefin-unsaturated acidic reagents) of this invention. Polyhydric alcohols are the preferred hydroxy compounds.

Suitable polyols which can be employed include aliphatic polyhydric alcohols containing up to about 100 carbons atoms and about 2 to 10 hydroxy groups. The polyols can be substituted or unsubstituted, hindered or unhindered, branch or straight chain, etc. as desired. Typical alcohols are alkylene glycols, and polyalkylene glycols in which the alkylene radical contains from 2 to about 8 carbons. Included in the polyhydric alcohols are alkane polyols that contain ether groups such as polyethylene oxide repeating units, as well as partially esterified polyols with monocarboxylic acids. Examples of such partially esterified polyols are sorbitol mono- or di-oleates, glycerol monooleate, and erythritol mono- or di-dodecanoates.

The Mannich base condensates/poly(olefin-unsaturated acidic reagents) additives of the present invention may likewise be further reacted with amino alcohols. Examples of hydroxy containing amines suitable for this purpose included ethanol amine; diethanol amine; triethanol amine; tris(hydroxymethyl) amino methane; N,N-di-(hydroxyethyl) ethylenediamine; N,N,N'-tris(hydroxypropyl) hexamethylene diamine; and the like. Mixtures of these or similar amines can be employed.

The nucleophilic reactants described above suitable for reaction with the polymeric Mannich base condensates/poly (olefin-unsaturated acidic reagents) additives of this invention include amines, alcohols, and amino alcohols.

The reaction between the Mannich base condensates/poly (olefin-unsaturated acidic reagents) polymeric dispersants and the prescribed amine compounds is conducted by heating an oil solution containing 5 to 95 wt. % of the reactants to about 100° C. to 200° C., generally for about 1 to 10 hours. Reaction ratios of the Mannich base condensates/poly (olefin-unsaturated acidic reagents) products to equivalents of amine or other nucleophilic reagents described herein can vary considerably, generally from 0.01 to 1.0, preferably about 0.2 to 0.6, equivalents of polymeric Mannich base/poly(olefin-unsaturated acidic reagents) product per equivalent of amine or nucleophilic reagent. The reactions with the described nucleophilic reagents may be conducted in the same or separate reaction vessels as the Mannich base condensates/poly(olefin-unsaturated acidic reagents) adducts.

Further aspects of this invention reside in the formation of post-treated derivatives and metal complexes. Suitable metal complexes may be formed in accordance with well known techniques of employing a reactive metal ion species during or after the formation of the polymeric dispersants of this invention. Post-treatment compositions of this invention include those formed by reacting the dispersants of this invention with one or more post treating agents, preferably (a) one or more boronating agents, preferably a boron acid (especially boric acid or metaboric acid), a boron oxide, a boron ester, or a boron salt (especially an ammonium borate); (b) one or more phosphorylating agents, preferably an inorganic acid of phosphorus (especially phosphorous acid), or an anhydride thereof, or any partial or complete sulfur analog thereof (such as inorganic sulfurous acid); (c) one or more acylating agents, preferably maleic anhydride, fumaric acid, maleic acid, glutaric acid, glutaric anhydride, succinic acid, $C_{1-30}$ alkyl succinic acid or anhydrides, adipic acid, glycolic acid, etc.; and (d) mixtures of any two (a), (b), and (c), or mixtures of all three of (a), (b), and (c).

Further exemplification of post treating agents and methods by which they can be employed in effecting post-treatment to improve ashless dispersants are documented in U.S. Pat. No. 5,464,549, incorporated herein by reference.

Further embodiments of the present invention include additive concentrates and lubricant or functional fluid compositions containing particular combinations of one or more lubricant additive components with the polymeric dispersant additive of this invention. In formulating finished lubricating oils or concentrates containing one or more of the ashless dispersants of the present invention, various other additives components can be utilized. These include low base sulfonates, sulfuized phenates and salicylates of lithium, sodium, potassium, calcium, and/or magnesium (note U.S. Pat. Nos. 5,114,601 and 5,205,946); antiwear and/or extreme pressure agents such as metal salts of dihydrocarbyl dithiophosphoric acids (e.g. zinc, copper, molybdenum dialkyldithiophosphates); oxidation inhibitors such as hindered phenolic antioxidants, aromatic amine antioxidants, sulfur containing antioxidants, and copper containing antioxidants; supplementary dispersants such as succinimide dispersants, succinic ester amide dispersants, and Mannich base dispersants; friction reducing agents and/or fuel economy improving additives such as glycerol monooleate, pentaerythritol monooleate; rust and corrosion inhibitors; foam inhibitors; viscosity index improvers; polymeric dispersant viscosity index improvers; demulsifying agents; and the like. Such additives can be employed in the base oil at their customary use concentrations, which are known to those skilled in the art. For additional details concerning such additives one may refer to, for example, U.S. Pat. Nos. 4,664,822: 4,908,145; 5,080,815; and 5,137,980, incorporated herein by reference.

The ashless dispersants of this invention can be incorporated in a wide variety of lubricants and functional fluids in effective amounts to provide suitable active concentrations. The base oils not only can be hydrocarbon oils of suitable lubricating viscosity derived from petroleum, but also can be natural oils of suitable viscosity such as rapeseed oil, etc., and synthetic oils such as hydrogenated polyolefin oils; poly-ax-olefins (e.g. hydrogenated or unhydrogenated cc-olefin oligomers such as hydrogenated poly-1-decene); alkyl esters of dicarboxylic acids; complex esters of dicarboxylic acids; alkyl esters of carbonic or phosphoric acids, polysilicones; fluorohydrocarbon oils; and mixtures of mineral, natural, and/or synthetic oils. The term "base oil" for this disclosure includes all the foregoing. In most cases, the base oil is preferably a petroleum derived mineral oil of the types conventionally used in forming passenger car or heavy duty diesel engine oils.

The products of this invention can thus be used in lubricating oil and functional fluid compositions, such as automotive crankcase lubricating oils, automatic transmission fluids, gear oils, hydraulic oils, cutting oils, etc., in which the base oil of lubricating viscosity is a mineral oil, synthetic oil, a natural oil such as a vegetable oil, or a mixture thereof. Certain types of base oils may be used in certain compositions for the specific properties they possess such as biodegradability, high temperature stability, non-flammability, etc. In other compositions, other types of base oils may be preferred for reasons of availability or cost. Thus, the skilled artisan will recognize that while the various base oils discussed above may be used in compositions of this invention, the respective base oils are not necessarily equivalents of each other in every instance.

The ashless dispersants of this invention can be blended into oils of lubricating viscosity separately and apart from other additive components. Preferably however, the dispersants are formulated into an additive concentrate or "package" which is then used in formulating the finished lubrication composition. The package will usually contain up to 50 wt % diluent with the balance being the active additive components, namely, at least one dispersant of this invention and optionally, but preferably, one or more other additive components, such as those referred to above and/or in various patents cited herein. From 5 to 60 wt. % of the concentrate can be one or more dispersants of this invention. This invention also provides a composition that consists of 1 to 99 wt. % of an active dispersant of this invention and from 99 to 1 wt. % of diluent oil. Other additives, including diluents that may be associated therewith, can be blended into such compositions to form additive packages of this invention.

The dispersants of this invention can also be used as additives in hydrocarbonaceous fuels such as gasoline, diesel fuel, gas oils, jet oils, cycle oils, burner fuels, bunker fuels, and the like. In fuels such as gasoline or diesel fuel, the additive products can be used as detergents for keeping the intake system clean and reducing intake valve deposits. Owing to their dispersant properties, they also have an advantageous effect on engine lubricants that they may enter during operation of the engine. A fuel composition comprising a hydrocarbon which boils in a gasoline or diesel boiling range and from 20 to 5000 parts per million, based on the weight of the fuel, of a dispersant additive of the invention is an embodiment of the present invention.

The following examples illustrate the practice and advantages achievable by the practice of this invention. These examples are not intended to limit, do not limit, and should not be construed as limiting the generic scope of this invention.

EXAMPLES

Preparation of Mannich Base Condensates

The following examples are representative preparations of the Mannich base condensates utilized in this invention. The high molecular weight alkyl phenols used in these preparations may be prepared via established procedures. The Mannich base condensates are characterized by infrared spectroscopy absorbances at around 825 $cm^{-1}$, 880 $cm^{-1}$, 950 $cm^{-1}$, 1500 $cm^{-1}$, and 1600 $cm^{-1}$.

Example 1

A 4 liter flask equipped with overhead stirrer, nitrogen inlet and outlet, Dean Stark trap, and thermometer was charged with 1200.0 grams of polybutene phenol (Mn 1743, 49.6 wt. % active), 36.50 grams of hexamethylene diamine, and 19.33 grams of oleic acid. The mixture was heated to 85–88° C. and stirred under continuous nitrogen purge. A 37 wt. % aqueous solution of formaldehyde (36.04 grams) was added to the above mixture over about 15 minutes. After an additional 15 minutes, the reaction temperature was then raised to 115° C. and a second portion of 37 wt. % aqueous formaldehyde (36.00 grams) was added over about 45 minutes. The resulting reaction mixture was held at 115 to 118° C. for an additional 3 hours while water was removed. A total of 56 grams of water was collected. Volatiles and residual water were removed in vacuo to yield about 1269 grams of product.

Example 2

A 0.5 liter flask equipped with overhead stirrer, nitrogen inlet and outlet, Dean Stark trap, and thermometer was charged with 175 grams of polybutene phenol (Mn 1743, 49.6 wt. % active), 4.72 grams of diethylenetriamine, and 2.81 grams of oleic acid. The mixture was heated to 85–88° C. and stirred under continuous nitrogen purge. A 37 wt. % aqueous solution of formaldehyde (6.10 grams) was added to the above mixture over about 15 minutes. After an additional 15 minutes, the reaction temperature was then raised to 115° C. and a second portion of 37 wt. % aqueous formaldehyde (6.00 grams) was added over about 45 minutes. The resulting reaction mixture was held at 115 to 118° C. for an additional 3 hours while water was removed. Volatiles and residual water were removed in vacuo to yield about 183.1 grams of product.

Example 3

A 1 liter flask equipped as in Example 1 under a nitrogen atmosphere was charged with 175.0 grams of polypropylene phenol (Mn 1050, 83.6 wt. % active), 9.17 grams of diethylenetriamine, 0.4 grams of oleic acid, and 50 ml of xylene. The resulting mixture was heated to 80° C. and 13.31 g of formalin was added over about 30 minutes. This mixture was then heated to 165° C. for 3 hours with removal of water, followed by vacuum stripping for removal of residual water and solvent. The mixture was filtered to afford 148.7 g of product Preparation of Mannich Condensates/Poly (Olefin-Unsaturated Acidic Reagents)

The following examples are representative preparations of the Mannich base condensates/poly (olefin-unsaturated acidic reagents) utilized in this invention. The Mannich base condensates/poly (olefin-unsaturated acidic reagents) are characterized by infrared spectroscopy absorbances at around 825 $cm^{-1}$, 880 $cm^{-1}$, 950 $cm^{31\ 1}$, 1500 $cm^{-1}$, 1600 $cm^{-1}$, 1699 $cm^{-1}$, and 1771 $cm^{-1}$.

Example 4

A 4 liter resin kettle equipped with overhead stirrer, nitrogen inlet and outlet, and thermometer was charged with 1000.0 grams of a polybutene phenol/hexamethylene diamine Mannich product prepared as in Example 1, 150.2 grams of poly(maleic anhydride-alt-octadecene) (Mn 30,000 to 50,000), and 349.6 grams of a diluent process oil. The reaction temperature was raised over about 1 hour to 115° C. and then raised to 140° C. and held for 3 hours. Volatiles and residual water were removed in vacuo to yield about 1492.2 grams viscous liquid product. The resulting product exhibited a 100° C. kinematic viscosity of 378 cSt Example 5

A 0.5 liter resin kettle equipped as in Example 4 was charged with 85.0 grams of a polybutene phenol/diethylenetriamine Mannich product prepared as in Example 2, 4.25 grams of poly(maleic anhydride-alt-octadecene) (Mn 30,000 to 50,000), and 30.30 grams of a diluent process oil. The reaction temperature was raised over about 1 hour to 120° C. and held for 30 minutes. A second 4.25 gram portion of the poly(maleic anhydride-alt-octadecene) was then added and the reaction temperature raised to and maintained at 140° C. 3 hours. Volatiles and residual water were removed in vacuo to yield about 122.6 grams viscous liquid product.

Example 6

A 0.5 liter resin kettle equipped as in Example 4 was charged with 70.0 grams of a polypropylene phenol/diethylenetriamine Mannich product prepared as in Example 3, 7.42 grams of poly(maleic anhydride-alt-octadecene) (Mn 30,000 to 50,000), and 68.52 grams of a diluent process oil. The reaction temperature was raised over about 1 hour to 115° C. and then raised to 140° C. and held for 3 hours. Volatiles and residual water were removed in vacuo to yield about 144.9 grams viscous liquid product.

Example 7

A 0.5 liter flask equipped as in Example 4 was charged with 150.01 grams of a polybutene phenol/hexamethylene diamine Mannich product. The Mannich product was prepared as in Example 1 except utilizing the following: 400 grams polybutene phenol (Mn 1879, 50.76% active), 14.2 grams of hexamethylene diamine, 6.12 grams of oleic acid, and 22.92 grams of 37 wt. % aqueous formaldehyde. To the flask containing the 150.01 grams of polybutene phenol/hexamethylene diamine Mannich product, 12.94 grams of poly(maleic anhydride-alt-octadecene) (Mn 30,000 to 50,000), and 60.07 grams of a diluent process oil were added. The reaction temperature was raised over about 1 hour to 120° C. and then raised to 140° C. and held for 3 hours. Volatiles and residual water were removed in vacuo to yield about 222.4 grams viscous liquid product. The resulting product exhibited a 100° C. kinematic viscosity of 1574.5 cSt.

Example 8

A 0.1 liter flask equipped as in Example 4 was charged with 40.77 grams of a polybutene phenol/hexamethylene diamine Mannich product prepared as in Example 1, 1.16 grams of poly(styrene-co-maleic acid) (Mn 2300), and 8.60 grams of a diluent process oil. The reaction temperature was raised over about 1 hour to and maintained at 145° C. for an additional 1.5 hours. Volatiles and residual water were removed in vacuo. The resulting product was filtered through a filter aid to afford about 40.8 grams of product. The resulting product exhibited a 100° C. kinematic viscosity of 269 cSt.

Table 1 exemplifies various analogues utilizing the basic procedure detailed in Example 4. The following abbreviations are used in this table: PBP/HMDA denotes the Mannich product of polybutene phenol and hexamethylene diamine prepared according to Example 1, g denotes grams, MAN/C18 denotes poly(maleic anhydride-alt-octadecene); KV 100° C. denotes kinematic viscosity at 100° C., and cSt denotes centisokes. The cited mole % for the MAN/C 18 is relative to the moles of hexamethylene diamine present in the starting PBP/HMDA. Example 9 represents the starting PBP/HMDA. The products of Examples 9 and 10 were subsequently diluted to about 40 wt. % active to match Examples 11 and 12 for viscometric comparisons of these products.

TABLE 1

Mannich Condensates/Poly(Olefin-Unsaturated Acidic Reagents) Example 4 Analogs

| Example # | PBP/HMDA (g) | MAN/C18 (g) | DILUENT (g) | MAN/C18 Mole % | KV 100° C. (cSt) |
|---|---|---|---|---|---|
| 9 | 50.0 | 0.00 | 0.00 | 0.0 | 170 |
| 10 | 50.0 | 2.45 | 0.00 | 0.5 | 326 |
| 11 | 50.0 | 4.90 | 22.60 | 1.0 | 433 |
| 12 | 50.0 | 7.47 | 25.44 | 1.5 | 471 |

Thus, while the relatively low viscosity/molecular weights of conventional monomeric Mannich base condensates is dictated by the size of the hydroxy aromatic alkyl substituent, the present invention permits an advantageous adjustment of viscosity and molecular weight for the polymeric Mannich additives without requiring a change in the hydroxy aromatic alkyl substituent.

Reactions of Mannich Condensates/Poly (Olefin-Unsaturated Acidic Reagents) Products with Nucleophilic Agents Example 13

A 2 liter resin kettle equipped with overhead stirrer, nitrogen inlet and outlet, Dean Stark trap, and thermometer was charged with 700.0 grams of a polybutene phenol/hexamethylene diamnine/poly(maleic anhydride-alt-octadecene) additive prepared according to Example 4, and 71.86 grams of diluent oil. The reaction mixture was then heated to 119° C. with stirring and a continuous nitrogen purge. 17.50 grams of tetraethylene pentamine were added portionwise to the reaction mixture over about 5 minutes. The reaction temperature was then raised to 140° C. and held for 3 hours. Volatiles and residual water were removed in vacuo to yield about 734.3 grams of product after filtration through filter aid. The resulting product exhibited a 100° C. kinematic viscosity of 408 cSt.

Example 14

A 0.5 liter resin kettle equipped with overhead stirrer, nitrogen inlet and outlet, Dean Stark trap, and thermometer was charged with 50.0 grams of a polybutene phenol/hexamethylene diamine/poly(maleic anhydride-alt-octadecene) additive prepared according to Example 4, 1.0 gram of partially propoxylated hexamethylene diamine (containing an average of 3 propoxyl groups), and 3.89 grams of diluent oil. The reaction mixture was then heated to and maintained at 140° C. for 3 hours. Volatiles and residual water were removed in vacuo to yield about 54.4 grams of product.

Example 15

A 2 liter resin kettle equipped with overhead stirrer, nitrogen inlet and outlet, Dean Stark trap, and thermometer was charged with 800.8 grams of a polybutene phenol/hexamethylene diamine/poly(maleic anhydride-alt-octadecene) additive prepared according to Example 4. After heating to 120° C. with stirring and a continuous nitrogen purge, a slurry of 15.2 grams of aminoguanidine bicarbonate in 62.6 grams of diluent oil was added over about 5 minutes. The reaction temperature was then raised to 140° C. and held for 3 hours. Volatiles and residual water were removed in vacuo to yield about 867.6 grams of viscous liquid product. This product was then filtered through 15.0 grams of filter aid to afford 832.1 grams of product. The resulting product exhibited a 100° C. kinematic viscosity of 504 cSt.

Example 16

A 0.5 liter resin kettle equipped with overhead stirrer, nitrogen inlet and outlet, Dean Stark trap, and thermometer was charged with 108.75 grams of a polybutene phenol/hexamethylene diamine/poly(maleic anhydride-alt-octadecene) additive prepared according to Example 4, and 11.34 grams of diluent oil. The reaction mixture was then heated to 110° C. with stirring and a continuous nitrogen purge. 1.10 grams of tris(aminoethyl)amine were added portionwise to the reaction mixture over about 5 minutes. The reaction temperature was then raised to 145° C. and held for 3 hours. Volatiles and residual water were removed in vacuo to yield about 120.2 grams of product. The resulting product exhibited a 100° C. kinematic viscosity of 1651 cSt.

Example 17

A 0.25 liter flask equipped with overhead stirrer, nitrogen inlet and outlet, Dean Stark trap, and thermometer was charged with 125.46 grams of a polybutene phenol/hexamethylene diamine/poly(maleic anhydride-alt-octadecene) additive prepared according to Example 4. The reaction mixture was then heated to 110° C. with stirring and a continuous nitrogen purge. 2.94 grams of distilled N-phenyl-1,4-phenylenediamine were added portionwise to the reaction mixture over about 5 minutes. The reaction temperature was then raised to 155° C. and held for 3 hours. Volatiles and residual water were removed in vacuo to yield about 119.6 grams of product after filtration through a filter aid.

Example 18

A 0.25 liter flask equipped with overhead stirrer, nitrogen inlet and outlet, Dean Stark trap, and thermometer was charged with 100.0 grams of a polybutene phenol/hexamethylene diamine/poly(maleic anhydride-alt-octadecene) additive prepared according to Example 4, and 8.68 g of diluent oil. The reaction mixture was then heated to 120° C. with stirring and a continuos nitrogen purge. 1.70 grams of 1-(2-aminoethyl) piperazine were added portionwise to the reaction mixture over about 5 minutes. The reaction temperature was then raised to 140° C. and held for 3 hours. Volatiles and residual water were removed in vacuo to yield about 107.6 grams of product. The resulting product exhibited a 100° C. kinematic viscosity of 998 cSt.

Example 19

A 0.5 liter resin kettle equipped with overhead stirrer, nitrogen inlet and outlet, Dean Stark trap, and thermometer was charged with 100.0 grams of a polybutene phenol/hexamethylene diamine/poly(maleic anhydride-alt-octadecene) additive prepared according to Example 4, and 11.29 grams of diluent oil. The reaction mixture was then heated to 120° C. with stirring and a continuous nitrogen purge. 3.00 grams of 4-(3-aminopropyl)morpholine were added to the reaction mixture over about 5 minutes. The reaction temperature was then raised to 140° C. and held for 3 hours. Volatiles and residual water were removed in vacuo to yield about 111.9 grams of product. The resulting product exhibited a 100° C. kinematic viscosity of 358 cSt Example 20

A 0.5 liter resin kettle equipped with overhead stirrer, nitrogen inlet and outlet, Dean Stark trap, and thermometer was charged with 125.0 grams of a polybutene phenol/hexamethylene diamine/poly(maleic anhydride-alt-octadecene) additive prepared according to Example 4, and 11.29 grams of diluent oil. The reaction mixture was then heated to 120° C. with stirring and a continuous nitrogen purge. 2.50 grams of 1-(3-aminopropyl)imidazole were added to the reaction mixture over about 5 minutes. The reaction temperature was then raised to 140° C. and held for 3 hours. Volatiles and residual water were removed in vacuo to yield about 134.3 grams of product. The resulting product exhibited a 100° C. kinematic viscosity of 416 cSt.

Post-treatments

Example 21

A 2 liter resin kettle equipped with overhead stirrer, nitrogen inlet and outlet, Dean Stark trap, and thermometer was charged with 850.0 grams of a polybutene phenol/hexamethylene diamine/poly(maleic anhydride-alt-octadecene) additive prepared according to Example 4. After heating to 155° C. with stirring and a continuous nitrogen purge, a slurry of 29.4 grams of boric acid in 107.3 grams of diluent oil was added over about 5 minutes. The reaction temperature was maintained at 155–158° C .for 3 hours with water removal (7.2 grams). Volatiles and residual water were removed in vacuo to yield about 973.2 grams of product that affords about 911.1 grams of product upon filtration through filter aid. The resulting product exhibited a 100° C. kinematic viscosity of 538 cSt.

Example 22

A 2 liter resin kettle equipped with overhead stirrer, nitrogen inlet and outlet, Dean Stark trap, and thermometer was charged with 700.0 grams of a polybutene phenol/hexamethylene diamine/poly(maleic anhydride-alt-octadecene)/aminoguanidine bicarbonate additive prepared according to Example 15. After heating to 155° C. with stirring and a continuous nitrogen purge, a slurry of 13.69 grams of boric acid in 48.90 grams of diluent oil was added over about 5 minutes. The reaction temperature was maintained at 155–158° C. for 3 hours with water removal. Volatiles and residual water were removed in vacuo to yield about 753.0 grams of product that affords about 694.8 grams of product upon filtration through filter aid. The resulting product exhibited a 100° C. kinematic viscosity of 405 cSt.

Example 23

A 2 liter resin kettle equipped with overhead stirrer, nitrogen inlet and outlet, Dean Stark trap, and thermometer was charged with 891.9 grams of a polybutene phenol/hexamethylene diamine/poly(maleic anhydride-alt-octadecene)/tetraethylene pentamine additive prepared according to Example 13. After heating to 155° C. with stirring and a continuous nitrogen purge, a slurry of 31.87 grams of boric acid in 143.51 grams of diluent oil was added over about 5 minutes. The reaction temperature was maintained at 155–158° C. for 3 hours with water removal. Volatiles and residual water were removed in vacuo. Maleic anhydride (0.58 grams) was then added to the resulting mixture and reacted for an additional 30 minutes. Volatiles and residual maleic anhydride were removed in vacuo to yield about 1054.3 grams of product that affords 984.6 grams of product upon filtration through filter aid. The isolated product exhibited a 100° C. kinematic viscosity of 966 cSt.

Example 24

A 0.5 liter resin kettle equipped with overhead stirrer, nitrogen inlet and outlet, Dean Stark trap, and thermometer was charged with 210.45 grams of a polybutene phenol/hexamethylene diamine/poly(maleic anhydride-alt-octadecene)/1-(2-aminoethyl) piperazine additive prepared according to Example 18. After heating to 155° C. with stirring and a continuous nitrogen purge, a slurry of 6.90 grams of boric acid in 14.55 grams of diluent oil was added over about 5 minutes. The reaction temperature was maintained at 155–158° C. for 3 hours with water removal. Volatiles and residual water were removed in vacuo to yield about 227.9 grams of product.

Example 25

A 0.25 liter flask equipped with overhead stirrer, nitrogen inlet and outlet, Dean Stark trap, and thermometer was charged with 210.45 grams of a polybutene phenol/hexamethylene diamine/poly(maleic anhydride-alt-octadecene)/tetraethylene pentamine additive prepared according to Example 13. After heating to 120° C. with stirring and a continuous nitrogen purge, 5.81 grams of a 70 wt. % aqueous solution of glycolic acid were added over about 45 minutes. The reaction temperature was raised to and maintained at 140° C. for 3 hours with water removal. Volatiles and residual water were removed in vacuo to yield about 127.77 grams of product.

PERFORMANCE EVALUATIONS

Spot Dispersancy Test

The polymeric additives of this invention have equivalent or improved dispersancy performance in the Spot Dispersancy Test as compared to a commercial Mannich dispersant (HiTEC® 7049 dispersant available from Ethyl Corporation of Richmond, Va.) and a commercial succinimide dispersant (HiTEC® 646 dispersant available from Ethyl Corporation of Richmond, Va.). The Spot Dispersancy Test affords a measure of an additive's ability to disperse sludge. In the Spot Dispersancy Test, a dispersant candidate is mixed with an amount of Sequence VE sludge oil and is incubated at 300° F. for 16 hours. The resulting mixture (3–10 drops) is dropped onto a standard white blotter paper producing a sludge oil spot. After 24 hours, the diameter of the sludge and the oil rings are measured. As dispersancy is the ability of an oil to keep sludge in suspension, dispersancy in the Spot Dispersancy Test is reflected by the difference in diameters of the sludge and oil rings. The sludge ring being nearly as wide as the oil ring reflects high dispersancy. Multiplying the quotient of the sludge ring and the oil ring diameters by 100 produces a rating (SDT Rating). A high numerical rating is indicative of good dispersancy. Table 1 depicts the Spot Dispersancy Test performance of several additives of the present invention. Commercial dispersant 1 refers to the commercial HiTEC® 7049 Mannich dispersant and Commercial dispersant 2 refers to the commercial HiTEC® 646 succinimide dispersant.

TABLE 2

Spot Dispersancy Test Results

| Sample | SDT Rating |
|---|---|
| Commercial 1 | 69.7 |
| Commercial 2 | 74.8 |
| Example 1 | 65.0 |
| Example 4 | 84.4 |
| Example 8 | 68.0 |
| Example 13 | 75.2 |
| Example 14 | 69.5 |

TABLE 2-continued

Spot Dispersancy Test Results

| Sample | SDT Rating |
|---|---|
| Example 15 | 71.0 |
| Example 17 | 76.2 |
| Example 18 | 89.4 |
| Example 19 | 92.1 |
| Example 22 | 76.6 |
| Example 23 | 86.9 |
| No Dispersant | 41.8 |

Viscosity Index Improver Credit

Additives of this invention, a commercial Mannich dispersant (HiTEC® 7049 dispersant), and a commercial succinimide dispersant (HiTEC® 646 dispersant) were blended into a motor oil formulation utilizing metal-containing sulfonates, zinc dithiophosphate wear inhibitors, sulfur containing antioxidants, a pour point depressant, and a viscosity index improver. Additives of the invention and the commercial Mannich dispersant were of nearly equal activities (around 40 wt. %), while the commercial succinimide dispersant was at a higher activity of 65 wt %. The additives of the present invention impart significantly higher 100° C. viscosities to motor oil formulations than the two commercial dispersants by virtue of the advantageous polymeric nature of the additives of this invention. More importantly, the dispersants of this invention impart 100° C. viscosity lift to finished oils with no adverse effects on low temperature viscometrics.

The additives of this invention also contribute viscosity index improver credit to finished oils, reducing the amount of conventional viscosity index improver required to achieve a desired viscosity target. Reducing the amount of viscosity index improver in a motor oil can thus offer both cost and engine cleanliness advantages. Table 3 details viscosity index improving credit advantages exhibited by several polymeric dispersants of this invention. For oils formulated as described above, 4 wt. % of the Commercial dispersant 1 or Commercial dispersant 2 required 8.0 wt. % of HiTEC® 5770 viscosity index improver, supplied by Ethyl Corporation, to meet a viscosity target of 10.0 to 10.6 centi-stokes (cSt). On the other hand, the polymeric dispersants additives of the invention require lower amounts (7.5 to 25 wt. % less) of this same viscosity index improver to meet or exceed the 100° C. viscosity target. More oils were formulated as described above using 4.8 wt. % dispersant and Shellvis® 300 viscosity index improver supplied by Shell Chemical Company. The Commercial dispersant 1 required 6.8 wt. % of the viscosity index improver to meet a similar viscosity target. Again, the polymeric dispersants additives of the invention required lower amounts (12.5 to 22 wt. % less) of this same viscosity index improver to meet or exceed the 100° C. viscosity target.

While oils formulated with the commercial dispersants at indicated viscosity index improver (VII) levels meet the 100° C. viscosity targets, these blends fail to meet the 5W30 low temperature −25° C. cold crank simulator specification of less than 3500 centipoise (cP). By contrast, the polymeric dispersants of this invention advantageously impart blending versatility by addressing both the low and high temperature 5W30 specifications.

TABLE 3

Viscometric Evaluations

| SAMPLE | Dispersant Wt. % | VII Wt. % | VII Type | 100° C. VISCOSITY (cSt) (9.3 min) | −25° C. COLD CRANK (cP) (3500 max) |
|---|---|---|---|---|---|
| Commercial 1 | 4.00 | 8.00 | H-5770 | 10.52 | 3533 |
| Commercial 2 | 4.00 | 8.00 | H-5770 | 10.57 | 3920 |
| Commercial 1 | 4.80 | 6.80 | Shellvis | 10.63 | 3560 |
| Example 10 | 4.00 | 8.00 | H-5770 | 11.28 | 3470 |
| Example 11 | 4.00 | 8.00 | H-5770 | 11.39 | 3360 |
| Example 12 | 4.00 | 8.00 | H-5770 | 11.10 | 3360 |
| Example 13 | 4.00 | 6.75 | H-5770 | 10.41 | 3080 |
| Example 23 | 4.00 | 7.00 | H-5770 | 10.51 | 3110 |
| Example 16 | 4.80 | 5.10 | Shellvis | 10.66 | 3350 |
| Example 18 | 4.00 | 6.27 | H-5770 | 10.70 | 3260 |
| Example 20 | 4.00 | 6.27 | H-5770 | 10.21 | 3250 |
| Example 21 | 4.80 | 6.30 | Shellvis | 10.55 | 3340 |
| Example 22 | 4.00 | 7.0 | H-5770 | 10.23 | 3140 |
| Example 22 | 4.80 | 6.27 | Shellvis | 10.44 | 3350 |
| Example 24 | 4.80 | 6.27 | Shellvis | 10.89 | 3380 |

Soot Thickening Test Performance

The ability of the dispersants of the present invention to disperse soot and soot induced oil thickening was measured in a soot thickening bench test. In this test, the dispersant in a fully formulated lubricant composition is sheared in the presence of carbon black, a soot mimic. A mixture of 95.5 wt. % of a lubricating composition and 4.5 wt. % of Vulcan 9A32 carbon black is sheared with a mechanical homogenizer. The lubricating composition contains the test dispersant at 6.5 wt. % on an as is basis, as well as metal-containing sulfonates, zinc dithiophosphate wear inhibitors, sulfur containing antioxidants, a pour point depressant, and a viscosity index improver supplied by Ethyl Corporation (HiTEC® 5772 VII). The mixture of the lubricating composition with the test dispersant and the carbon black is mixed for 3 minutes with a Biospecs Products BioHomogenizer (Model Ml 33/1281-0) and then heated in a Bransonic Ultrasonic (Model 5200) for 1 hour at 60° C. The resulting mixture is then allowed to stand at room temperature for 16 hours. The viscosity of the sooted mixture and its fresh oil analog is then measured at 100° C. using a capillary viscometer. The percent viscosity increase is calculated by comparing the viscosity of the fresh oil and its counterpart treated with carbon black. Lower percent viscosity increases are indicative of better soot dispersancy.

Soot Thickening Test results for polymeric dispersants of Examples 15 and 23 are set forth in Table 4. The dispersants of this invention exhibit excellent soot dispersancy in the Soot Thickening Test.

TABLE 4

Soot Thickening Test Results

| SAMPLE | VII Wt. % | Fresh Oil KV 100° C. (cSt) | Soot Thickening % Δ Viscosity |
|---|---|---|---|
| Commercial 1 | 3.57 | 15.15 | 36.4 |
| Example 23 | 3.21 | 16.52 | 35.3 |
| Example 15 | 3.21 | 15.48 | 5.2 |

Sequence VE Engine Test Performance

A polymeric dispersant of this invention prepared as in Example 22 was blended into a motor oil formulation utilizing metal-containing sulfonates, zinc dithiophosphate wear inhibitors, sulfur containing antioxidants, a pour point depressant, and a viscosity index improver supplied by Shell Chemical Company (Shellvis® 300). The resulting formulation and an analogous formulation containing Commercial dispersant 1 defined above were evaluated in the Sequence VE engine test (ASTM Test Method D5302) which measures dispersancy and wear protection in simulated severe field service characterized by "stop and go" city driving and moderate motorway operation. The "VE" measures dispersancy by rating average engine sludge (AES) and Rocker Cover Sludge (RCS) on a scale of 1 to 10, 10 being the best. The "VE" also measures wear protection by quantifying average cam wear (ACW), and maximum cam shaft wear (MCW). The level of zinc dithiophosphate antiwear agents in these particular formulations was targeted to deliver about 725 parts per million (ppm) of phosphorus. Such a phosphorus level provides a severe Sequence VE engine test assessment. The comparative VE engine test results are given in Table 5.

TABLE 5

Sequence VE Engine Test Results

| | Phosphorus Wt. % | Nitrogen Wt. % | AES | RCS | ACW | MCW |
|---|---|---|---|---|---|---|
| Commercial 1 | 740 | 782 | 3.04 | 1.99 | 225 | 324 |
| Example 15 | 700 | 568 | 8.55 | 7.37 | 73.2 | 113.2 |
| | | Limits: | ≧9.0 | ≧7.0 | ≦127 | ≦380 |

As can be seen from the Sequence VE engine test results, the lubricating composition of the present invention comprising the polymeric dispersant provided much better sludge and wear protection for the low phosphorus antiwear containing formulations.

Fluoroelastomer Seals Performance

Compounds of the present invention proved less aggressive to fluoroelastomer seals, as demonstrated in the Volkswagen P. VW-3344 Seal Test. The products of the invention were blended into a standard SAE 10W40 engine oils. The lubricants were then subjected to the Volkswagen P. VW 3344 Seal Test. As depicted in Table 6, the products of this invention afford improved tensile strengths and percent elongations prior to breaking versus the commercial dispersant.

TABLE 6

Fluoroelastomer Test Results

| Sample | Tensile Strength (Mpa) | Elongation % | Cracks |
|---|---|---|---|
| Commercial 2 | 5.4 | 109 | Yes |
| Example 21 | 10.4 | 185 | No |
| Example 22 | 8.6 | 159 | No |
| Example 15 | 8.5 | 174 | Yes |
| Limits | ≧8.0 | ≧160 | No |

Thus, the dispersants of this invention afford improved fluoroelastomer compatibility.

This invention is susceptible to considerable variation in its practice. Accordingly, this invention is not intended to be limited by the specific exemplifications set forth herein above. Rather, this invention is intended to embrace the subject matter within the spirit and scope of the appended claims and the permissible equivalents thereof.

What is claimed is:

1. An ashless dispersant comprising the reaction products of the following reactants:

1) at least one Mannich base condensation product of a hydrocarbyl hydroxy aromatic compound with an aldehyde and an amine, with
2) at least one poly(a-olefin-unsaturated acidic reagent), and
3) optionally the reaction products of reactants 1) and 2) above with amines, alcohols, amino alcohols, or mixtures thereof, and
4) optionally the post-treatment of above reaction products with at least one member selected from the group consisting of organic or inorganic phosphorus compounds or any partial or total sulfur analogs thereof, boronating agents and acylating agents.

2. The ashless dispersant according to claim 1 wherein the said poly (α-olefin-unsaturated acidic reagent) is an α-olefin/maleic anhydride copolymer.

3. The ashless dispersant of claim 1 wherein the said poly (α-olefin-unsaturated acidic reagent) is an α-olefin/maleic anhydride copolymer derived from an a:-olefin containing from 2 to 36 carbons.

4. The ashless dispersant of claim 1 wherein the said poly (α-olefin-unsaturated acidic reagent) is a poly (octadecene/maleic anhydride) copolymer.

5. The ashless dispersant of claim 1 wherein the said poly (α-olefin-unsaturated acidic reagent) is a poly (styrene/maleic anhydride) copolymer.

6. The ashless dispersant of claim 1 wherein said poly (α-olefin-unsaturated acidic reagent) has a molecular weight (Mn) of from about 10,000 to about 70,000.

7. The ashless dispersant of claim 1 wherein said Mannich base condensate product is derived from an alkyl substituted hydroxy aromatic compound, wherein the alkyl substituent has a molecular weight (Mn) of from about 400 to about 20,000.

8. The ashless dispersant of claim 7 wherein said Mannich base condensate product is derived from an alkyl substituted phenol, wherein the alkyl substituent has a molecular weight (Mn) of from about 400 to about 20,000.

9. The ashless dispersant of claim 8 wherein said Mannich base condensate product is derived from a polybutene substituted phenol compound, wherein said polybutene has a molecular weight (Mn) of from about 400 to about 20,000.

10. The ashless dispersant of claim 1 wherein said Mannich base condensate product is derived from an alkyl substituted hydroxy aromatic compound and a polyalkylene polyamine containing 2 to 4 amino groups per molecule.

11. The ashless dispersant of claim 10 wherein said Mannich base condensate product is derived from an alkyl substituted hydroxy aromatic compound and 1,2-alklyenediamine.

12. The ashless dispersant of claim 11 wherein said Mannich base condensate product is derived from an alkyl substituted hydroxy aromatic compound and hexamethylene diamine.

13. The ashless dispersant of claim 1 wherein said reactant 1) is a Mannich base condensate product derived from an alkyl substituted hydroxy aromatic compound, wherein said alkyl substituent has a molecular weight (Mn) of from about 400 to about 20,000, and hexamethylene diamine and reactant 2) is a poly (octadecene/maleic anhydride).

14. The ashless dispersant of claim 1 wherein the said reactant 1) is a Mannich base condensate product derived from an alkyl substituted hydroxy aromatic compound, wherein said alkyl substituent has a molecular weight (Mn)

of from about 400 to about 20,000, and hexamethylene diamine and reactant 2) is a poly (styrene/maleic anhydride).

15. An oil soluble dispersant additive useful in oleaginous compositions comprising the product(s) prepared by contacting the ashless dispersant of claim 13 with at least one nucleophilic reagent selected from the group consisting of amines, alcohols, amino alcohols, and mixtures thereof under conditions effective to form adducts.

16. An oil soluble dispersant additive useful in oleaginous compositions comprising the product(s) prepared by contacting the ashless dispersant of claim 14 with at least one nucleophilic reagent selected from the group consisting of amines, alcohols, amino alcohols, and mixtures thereof under conditions effective to form adducts.

17. The dispersant additive of claim 15 wherein the nucleophilic reagent is a polyalkylene polyamine containing 3 to 6 amino groups per molecule.

18. The dispersant additive of claim 17 wherein the nucleophilic reagent comprises tetraethylene pentamine.

19. The dispersant additive of claim 15 wherein the nucleophilic reagent is an N-substituted poly(hydroxyalkyl) amine or a mixture of a polyamine and a polyol.

20. The dispersant additive of claim 15 wherein the nucleophilic reagent is a basic salt of aminoguanidine.

21. The dispersant additive of claim 15 wherein the nucleophilic reagent is a primary or secondary aminoalkyl-substituted tertiary amine.

22. The dispersant additive of claim 21 wherein the primary or secondary aminoalkyl-substituted tertiary amine is 1-(3-aminopropyl)imidazole.

23. The dispersant additive of claim 21 wherein the primary or secondary aminoalkyl-substituted tertiary amine is 4-(3-aminopropyl)morpholine.

24. The dispersant additive of claim 15 wherein the nucleophilic reagent is tris(2-aminoethyl)amine.

25. An oil soluble dispersant additive comprising the product(s) prepared by contacting the ashless dispersant of claim 13 with one or more post-treating agents selected from the group consisting of inorganic or organic phosphorus compounds, or any partial or complete sulfur analogs thereof, boronating agents, and acylating agents.

26. The dispersant additive of claim 25 wherein the post-treating agent is an inorganic phosphorus acid or anhydride, an inorganic sulfurous acid, boric acid, an unsaturated dicarboxylic acid or precursor thereof, or a mixture thereof.

27. An oil soluble dispersant additive comprising the product(s) prepared by contacting the ashless dispersant of claim 14 with one or more post-treating agents selected from the group consisting of inorganic or organic phosphorus compounds, or any partial or complete sulfur analogs thereof, boronating agents, and acylating agents.

28. The dispersant additive of claim 17 which has been contacted with one or more post-treating agents selected from the group consisting of inorganic or organic phosphorus compounds, or any partial or complete sulfur analogs thereof, boronating agents, and acylating agents.

29. The dispersant additive of claim 28 wherein the post-treating agent is an inorganic phosphorus acid or anhydride, an inorganic sulfurous acid, boric acid, an unsaturated dicarboxylic acid or precursor thereof, or a mixture thereof.

30. The dispersant additive of claim 19 which has been contacted with one or more post-treating agents selected from the group consisting of inorganic or organic phosphorus compounds, or any partial or complete sulfur analogs thereof, boronating agents, and acylating agents.

31. The dispersant additive of claim 20 which has been contacted with one or more post-treating agents selected from the group consisting of inorganic or organic phosphorus compounds, or any partial or complete sulfur analogs thereof, boronating agents, and acylating agents.

32. The dispersant additive of claim 21 which has been contacted with one or more post-treating agents selected from the group consisting of inorganic or organic phosphorus compounds, or any partial or complete sulfur analogs thereof, boronating agents, and acylating agents.

33. A lubricant composition which comprises an oil of lubricating viscosity and a dispersant effective amount of an ashless dispersant according to claim 1.

34. A lubricant composition which comprises an oil of lubricating viscosity and a dispersant effective amount of an ashless dispersant according to claim 13.

35. A lubricant composition which comprises an oil of lubricating viscosity and a dispersant effective amount of an ashless dispersant according to claim 14.

36. A lubricant composition which comprises an oil of lubricating viscosity and a dispersant effective amount of a dispersant additive according to claim 17.

37. A lubricant composition which comprises an oil of lubricating viscosity and a dispersant effective amount of a dispersant additive according to claim 19.

38. A lubricant composition which comprises an oil of lubricating viscosity and a dispersant effective amount of a dispersant additive according to claim 20.

39. A lubricant composition which comprises an oil of lubricating viscosity and a dispersant effective amount of a dispersant additive according to claim 21.

40. A lubricant composition which comprises an oil of lubricating viscosity and a dispersant effective amount of a dispersant additive according to claim 25.

41. A lubricant composition which comprises an oil of lubricating viscosity and a dispersant effective amount of a dispersant additive according to claim 27.

42. A lubricant composition which comprises an oil of lubricating viscosity and a dispersant effective amount of a dispersant additive according to claim 28.

43. A lubricant composition which comprises an oil of lubricating viscosity and a dispersant effective amount of a dispersant additive according to claim 30.

44. A lubricant composition which comprises an oil of lubricating viscosity and a dispersant effective amount of a dispersant additive according to claim 31.

45. A lubricant composition which comprises an oil of lubricating viscosity and a dispersant effective amount of a dispersant additive according to claim 32.

46. A fuel composition comprising a hydrocarbon that boils in a gasoline or diesel boiling range and from 20 to 5000 parts per million of an ashless dispersant according to claim 1.

47. A fuel composition comprising a hydrocarbon that boils in a gasoline or diesel boiling range and from 20 to 5000 parts per million of an ashless dispersant according to claim 13.

48. A fuel composition comprising a hydrocarbon that boils in a gasoline or diesel boiling range and from 20 to 5000 parts per million of an ashless dispersant according to claim 14.

49. A fuel composition comprising a hydrocarbon that boils in a gasoline or diesel boiling range and from 20 to 5000 parts per million of a dispersant additive according to claim 17.

50. A method of dispersing soot in an engine, wherein said method comprises adding to and operating in said engine the lubricant composition of claim 33.

51. A method of reducing soot induced oil thickening, wherein said method comprises adding to an oil of lubricating viscosity an ashless dispersant according to claim 1.

52. A method of imparting viscosity lift to lubricating oils without adversely affecting low temperature viscometrics, wherein said method comprises adding to an oil of lubricating viscosity an ashless dispersant according to claim 1.

53. A method of reducing intake valve deposits in an engine, wherein said method comprises adding to and combusting in said engine the fuel composition of claim 46.

* * * * *